US005356760A

United States Patent [19]

Okumura et al.

[11] Patent Number: 5,356,760

[45] Date of Patent: Oct. 18, 1994

[54] SILVER HALIDE PHOTOGRAPHIC LIGHT-SENSITIVE MATERIAL WITH BLACK DYE FORMING COUPLER

[75] Inventors: Mitsuhiro Okumura, Sagamihara; Shigeo Tanaka, Tachikawa, both of Japan

[73] Assignee: Konica Corporation, Tokyo, Japan

[21] Appl. No.: 16,536

[22] Filed: Feb. 11, 1993

[30] Foreign Application Priority Data

Feb. 20, 1992 [JP] Japan ..... 4-070245

[51] Int. Cl.[5] ..... G03C 5/40; G03C 7/30; G03C 7/34

[52] U.S. Cl. ..... 430/402; 430/364; 430/565; 430/963

[58] Field of Search ..... 430/402, 565, 364, 963

[56] References Cited

U.S. PATENT DOCUMENTS 4,183,756 1/1980 Locker ..... 430/569
4,200,466 4/1980 Fujiwhara et al. ..... 430/402
4,225,666 9/1980 Locker et al. ..... 430/569
4,429,035 1/1984 Kato et al. ..... 430/402
4,436,798 3/1984 Shennan et al. ..... 430/402
4,439,518 3/1984 Postle ..... 430/402

FOREIGN PATENT DOCUMENTS

0313021A1 4/1989 European Pat. Off. .
3214116A1 11/1980 Fed. Rep. of Germany .

*Primary Examiner*—Richard L. Schilling
*Attorney, Agent, or Firm*—Finnegan, Henderson, Farabow, Garrett & Dunner

[57] ABSTRACT

A silver halide photographic light-sensitive material forming a black and white image is disclosed. The silver halide in the silver halide emulsion layer is silver chlorobromide having a silver chloride content of not less than 90 mol % and containing virtually no silver iodide; the emulsion layer contains a coupler selected from resorcinol-based dye-forming couplers and aminophenol-based dye-forming couplers, and gelatin in a coating weight of 1.0 to 1.5 g/m$^2$. The silver halide photographic light-sensitive material is processed by color development to form a black and white image.

11 Claims, No Drawings

SILVER HALIDE PHOTOGRAPHIC LIGHT-SENSITIVE MATERIAL WITH BLACK DYE FORMING COUPLER

FIELD OF THE INVENTION

The present invention relates to a black and white photographic light-sensitive material which contains a coupler producing an excellent neutral black-dye-image and is capable of being processed commonly with color photographic light-sensitive materials.

BACKGROUND OF THE INVENTION

In a typical black and white light-sensitive material, silver nitrate is used as a starting material. However, with sudden soaring prices and scarcity of silver in recent years, it has been a serious technical problem in the photographic industry to realize a method which utilizes as little silver as possible to obtain the necessary image density. Hitherto, various methods were proposed to minimize the use of silver.

Examples of the proposal include: (1) A method which increases covering power by a sensitization technique, (2) a method which forms grains into tabular or monodispersed form by use of a grain-adjusting technique and (3) a method which increases the density of the black and white image using a black coupler.

Usable methods for forming a neutral black and white image using a black coupler is disclosed in Japanese Patent Publication Open to Public Inspection (hereinafter referred to as Japanese Patent O.P.I. Publication) No. 42725/1977 featuring use of aminophenol-based coupler, Japanese Patent O.P.I. Publication Nos. 172336/1982, 5732/1983, and 140739/1983 featuring use of resorcinol-based coupler, and Japanese Patent O.P.I. Publication No. 58147/1982 featuring use of the three dye forming couplers, namely, yellow, magenta, and cyan couplers.

Of the above methods, those using aminophenol-based couplers or resorcinol-based couplers provide a relatively nearly neutral black and white image, but do not easily maintain a uniform tone from the low density portion to the high density portion. In the third method, it is difficult to adjust the speeds of the three types of dye forming couplers to produce a black and white image. A slight difference in the speed leads to deteriorated neutrality of image, preventing production of a monochromatic image, and differences in color-fastness during storage produces black and white image with poor gray balance, making this method very difficult to use.

On the other hand, in recent years from the viewpoint of shortening delivery time for photographic prints and improving print productivity, it has been common practice to use rapidly-developable silver halide with a high silver chloride content in the color photographic light-sensitive materials for printing in order to carry out rapid developing in mini-labs. In the mini-labs, the customer can easily obtain a color print from the exposed negative film, but he must wait for a long time to obtain a black and white print because the negative films must be printed in batches in labs specializing in black and white film printing, making it very inconvenient for the customer. For this reason, the photographic industry has been waiting for a light-sensitive material which contains a black-rendering coupler capable of being subjected to processed on the line common to color prints, and which contains silver halide having a high silver chloride content capable of high-speed developing.

Investigations made by the present inventors revealed that although using a high silver chloride content emulsion in conjunction with the foregoing aminophenol-based couplers or resorcinol-based couplers does give a black and white image using a processing solution capable of rapid developing, the obtained image exhibits poor neutrality in that the tone in the low density portion differs from that in the high density portion.

SUMMARY OF THE INVENTION

The present invention is intended to solve the above problems by providing a black and white light-sensitive material which is capable of being processed commonly with color photographic light-sensitive materials and which contains a coupler producing a neutral black dye image.

The silver halide photographic light-sensitive material of the present invention comprises a silver halide emulsion layer on a support. The silver halide in the silver halide emulsion is silver chlorobromide having a silver chloride content of not less than 90 mol % and containing substantially no silver iodide; and the emulsion layer comprises a coupler selected from resorcinol-based dye-forming couplers and aminophenol-based dye-forming couplers, and gelatin in a coating weight of 1.0 to 1.5 g/m$^2$.

DETAILED DISCLOSURE OF THE INVENTION

The silver halide grains used in the invention have a silver chloride content of not less than 90 mol %, and a silver bromide content of not more than 10 mol %; the grains contain substantially no silver iodide. The more preferable embodiment is silver bromochloride having a silver bromide content of 0.1 to 2 mol %. The silver halide grains may be used singly or in combination with other silver halide grains of different compositions, and may also be used in combination with silver halide grains having a silver chloride content of less than 90 mol %. In a silver halide emulsion layer containing silver halide grains having a silver chloride content of not less than 90 mol %, the silver halide grains having a silver chloride content of at least 90 mol% account for preferably at least 60 wt %, more preferably at least 80 wt % of the total silver halide grains of the emulsion layer. The individual silver halide grains may have uniform or different composition from the inside to outside of the grains; in the latter case, the composition may vary continuously or discontinuously.

The silver halide grains may come in any size, but from the viewpoint of photographic performance requirements such as rapid processability and high sensitivity, the size is preferably in the range of 0.2 to 1.6 μm, more preferably 0.25 to 1.2 μm.

The silver halide grain size distribution may be polydispersed or monodispersed. Preferred silver halide grains are monodispersed grains having a grain size distribution, defined by a coefficient of variation of not more than 0.22, preferably not more than 0.15. Here, the coefficient of variation is a coefficient indicating the extent of grain size distribution, and is shown by the following formula:

Coefficient of variation = Standard deviation of grain size distribution/average grain size The silver halide grains used in the invention may be prepared by the acidic method, the neutral method, or the ammonical method. The grains may be grown all at once or grown after seed grain formation. The same or different methods may be used to prepare and grow seed grains. As a mode of reacting soluble silver salt with soluble silver halide, the normal precipitation method, reverse precipitation method, or simultaneous precipitation method may be used singly or in combination, with preference given to the simultaneous precipitation method. Further, as a mode of the simultaneous precipitation method, a usable method is the pAg-controlled double jet method, which is disclosed for example in Japanese Patent O.P.I. Publication No. 48521/1979.

If necessary, a silver halide solvent such as thioether or imidazole may be used. Also, a compound containing a mercapto group, a nitrogen-containing heterocyclic compound, or a sensitizing dye compound may be added either during silver halide grain formation or after completion of grain formation.

The silver halide grains used in the invention may have any shape. A preferred shape is a cube having (100) planes forming a crystal surface.

It is also possible to use octahedral, tetradecahedral, dodecahedral grains, or other grain forms prepared by the methods disclosed in U.S. Pat. Nos. 4,183,756 and 4,225,666, Japanese Patent O.P.I. Publication No. 26589/1980, Japanese Patent Examined Publication No. 42737/1980, the Journal of Photographic Science, 21, 39 (1973) and other documents. Grains having twin crystal planes may also be used. The silver halide grains used in the invention may come in a uniform shape or a combination of various shapes.

During the formation of the silver halide grains and/or growth of the silver halide grains in the invention, metal ions may be incorporated in the grains and/or on the grains by adding a cadmium salt, a zinc salt, a lead salt, a thallium salt, an iridium salt or a complex salt thereof, a rhodium salt or a complex salt thereof, or an iron salt or a complex salt thereof. Also, reduction sensitization specks can be provided in and/or on the grains by subjecting the grains to an appropriate reducing atmosphere.

The unnecessary soluble salts contained in the silver halide grains in the emulsion may be removed from or retained in the grains after completion of grain growth.

In the invention, the silver halide grains used in the emulsion may be grains with which latent images are mainly formed on the grain surface, or grains with which latent images are mainly formed therein, with preference given to grains with which latent images are mainly formed on the grain surface.

In the invention, the emulsion is chemically sensitized by a conventional method. Specifically, methods which may be used singly or in combination are sulfur sensitization which uses either a sulfur-containing compound capable of reacting with silver ion or active gelatin, selenium sensitization which uses a selenium compound, reduction sensitization which uses a reducing substance, and noble metal sensitization which uses gold or other noble metal compounds, etc., with preference given to the noble metal sensitization and sulfur sensitization.

The emulsion can be chemically sensitized to the desired wavelength using a sensitizing dye. Sensitizing dyes which may be used include cyanine dyes, merocyanine dyes, complex cyanine dyes, complex merocyanine dyes, holopolar cyanine dyes, hemicyanine dyes, styryl dyes and hemioxanol dyes. Typical examples of such sensitizing dyes include Exemplified Compound Nos. BS-1 through BS-9, GS-1 through GS-5, and RS-1 through RS-8 and IRS-1 through IRS-10 disclosed on pages 76 through 82 of Japanese Patent Application No. 76278/1990. Also supersensitizers which may be used in combination with these sensitizing dyes include Exemplified Compound Nos. SS-1 through SS-9 disclosed on pages 84 through 85 of Japanese Patent Application No. 76278/1990.

The silver halide emulsion of the present invention can be color sensitized using the above sensitizing dyes to prepare a blue-, green-, and red-sensitive emulsions, and are preferably incorporated into at least two layers formed on a support, wherein each layer has independent color sensitivity. For example, a light-sensitive print material color negative films consists of blue-, green-, and red-sensitive layers in that order formed on a support. Then, it is a preferred embodiment that each layer contains the black coupler of the invention.

Various compounds may be added in the photographic emulsion of the silver halide photographic light-sensitive material of the invention to prevent reduced sensitivity and fog occurrence during the manufacture, storage, and processing of the light-sensitive material. Many examples of such compounds are known, which include 4-hydroxy-6-methyl-1,3,3a,7-tetrazaindene, 3-methyl-benzothiazole, 1-phenol-5-mercapto tetrazole, as well as heterocyclic compounds, mercury-containing compounds, mercapto compounds, and metallic salts. Especially useful are those represented by formula S disclosed in Japanese Patent O.P.I. Publication No. 86135/1989, of which those represented by SB are preferred because of its ability to improve the gray neutrality of the colored dye.

The resorcinol-based and aminophenol-based coupler can be represented respectively by the following formulas a and b.

(a)

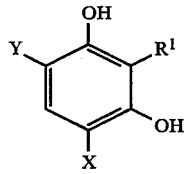

Wherein $R^1$ represents a hydrogen atom, a substituted or unsubstituted alkyl group, preferably having 1 to 20 carbon atoms, a $—COR^2$ group, an $—NHCOR^2$ group, a $—CONHR^2$ group,

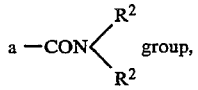

an $—SO_2NHR^2$ group,

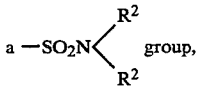

or an $—SO_2R^2$ group; $R^2$ represents a substituted or unsubstituted alkyl group, preferably having 1 to 20 carbon atoms, or a substituted or unsubstituted aryl group, preferably having 1 to 20 carbon atoms.

In the formula, X and Y independently represent a hydrogen atom, a substituted or unsubstituted alkyl group, preferably having 1 to 20 carbon atoms, or a halogen atom; Examples of substituents include an aryl group, a hydroxy group, an alkoxy group, and a halogen atom.

(b)

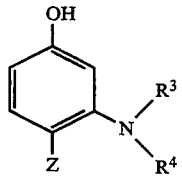

Wherein $R^3$ and $R^4$ independently represent a hydrogen atom, a substituted or unsubstituted alkyl group, preferably having 4 to 20 carbon atoms, a substituted or unsubstituted aryl group, preferably having 4 to 20 carbon atoms, or a substituted or unsubstituted alkenyl group, preferably having 4 to 20 carbon atoms; Z represents a hydrogen atom, a sulfone group, or a halogen atom; Examples of substituents include an aryl group, a hydroxy group, an alkoxy group, and a halogen atom.

Typical examples of resorcinol-based and aminophenol-based coupler compounds represented by the above formula a and b are shown below.

(a-1)

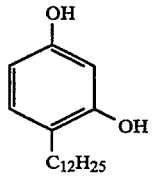

(a-2)

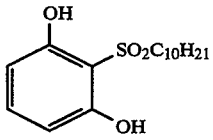

(a-3)

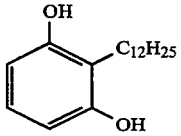

(a-4)

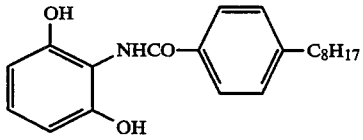

(a-5)

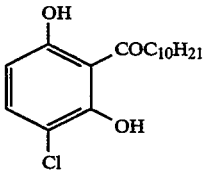

(a-6)

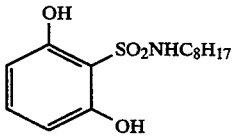

-continued (b-1)

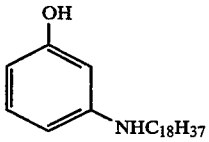

(b-2)

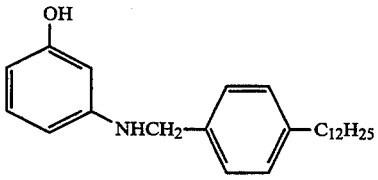

(b-3)

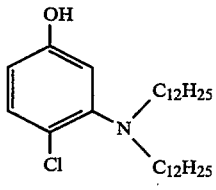

(b-4)

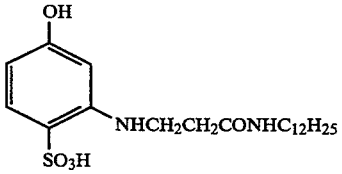

(b-5)

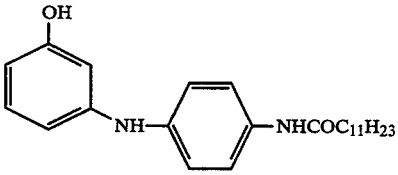

These compounds can be readily synthesized using the methods described in, for example, Japanese Patent O.P.I. Publication Nos. 42725/1977 and 5732/1983.

The addition amount of the coupler represented by the above formula a or b is preferably 3 to 15 mol %, more preferably 5 to 10 mol % per mol of silver halide. The silver halide emulsion contains at least one layer. When it contains two or more layers, a coupler may be added in an amount of 3 to 15 mol % per mol of total silver halide content in these layers, and the addition amount to each layer is not particularly limited. The above coupler is dissolved in a solvent having a high boiling point of at least 175° C. such as trichresilphosphate or dibutylphtalate, and at a proper timing before coating, the resulting coupler solution is added to the emulsion. It is particularly preferable to add the coupler solution after the addition of a sensitizing agent during chemical ripening.

The coating weight of gelatin content of the silver halide photographic light-sensitive material of the invention is from 1.0 to 1.5 g/m$^2$ in a layer or layers containing the silver halide emulsion and the black-coupler. This is because that a slight difference in the gelatin content greatly affects the neutrality of the colored black coupler. A gelatin content below the above range of the invention causes the tone in the low density portion to differ from that in the high density portion of the colored black coupler. A gelatin content greater than the above range of the invention causes the tone in the medium density portion to differ from those in other density portions. To sum up, deviation from this range will cause the so-called dichroism or trichroism.

The jelly strength of the gelatin (determined by the PAGI method) used in the invention is preferably not less than 250 g, more preferably not less than 270 g.

The calcium content of the gelatin used in the invention (determined by the PAGI method) is preferably not more than 1000 ppm, more preferably not more than 500 ppm. Usually, the calcium content of the gelatin is reduced preferably by a method which utilizes ion exchange resin column.

The molecular weight of the gelatin of the invention is not particularly limited, but the average molecular weight is preferably in the range of 10,000 to 200,000.

Any type of gelatin may be used for the invention as long as it satisfies the above requirements. Examples include the so-called alkali-treated gelatin, acid-treated gelatin, enzyme-treated gelatin, gelatin derivatives, and modified gelatin, with greatest preference given to alkali-treated ossein gelatin for realizing the object of the invention.

The gelatin incorporated in the light-sensitive material of the invention is hardened by a hardener.

Hardeners which may be used are not particularly limited. Examples of hardeners known in the photographic industry include those based on aldehyde, active vinyl, active halogen, epoxy, ethyleneimine, methane sulfonate, carbodiimide, isoxazole; carboxyl-activated hardeners such as carbamoylpyridinium and polymeric hardeners. Particular preference is given to vinyl sulfone based hardeners such as Compound Nos. H-1 to H-24 described on pages 13 to 14 of Japanese Patent O.P.I. Publication No. 188753/1990), and/or those based on chlorotriazine such as Compound Nos. II-1 to II-13, and III-1 to III-10 described on pages 20 to 21 of Japanese Patent O.P.I. Publication No. 216340/1989, or the carboxyl-activated hardeners described in Japanese Patent O.P.I. Publication Nos. 82237/1990 and 129245/1989.

The swelling rate of the light-sensitive material of the invention (the ratio of the film thickness of the hydrophilic colloid layer in the processing solution to the film thickness of the hydrophilic colloid layer in a dry state) is preferably 1.5 to 4.0, more preferably 2.0 to 3.0.

The light-sensitive material of the invention may incorporate an anti-foggant, an image stabilizer, a hardener, a plasticizer, an anti-irradiation dye, a polymer latex, an ultraviolet absorbent, a formalin scavenger, a developing accelerator, a developing retarder, a brightening agent, a matting agent, a lubricant, an antistatic agent, a surfactant, or other additives. These compounds are described in, for example, Japanese Patent O.P.I. Publication Nos. 215272/1987 and 46436/1988.

In processing the light-sensitive material of the invention, the color developing agent used in the color developer is an aminophenol-based compound or p-phenylenediamine-based compound, each used widely in various color photographic processes, with particular preference given to an aromatic primary amine color developing agent, i.e., p-phenylenediamine-based compound.

Examples of the aromatic primary amine based developing agent are given below.

(1) N,N-dimethyl-p-phenylenediamine hydrochloride
(2) N-methyl-p-phenylenediamine hydrochloride
(3) 2-amino-5-(N-ethyl-N-dodecylamino)toluene
(4) N-ethyl-N-(b-methanesulfonamidoethyl)-3-methyl-4-aminoaniline sulfate salt
(5) N-ethyl-N-(b-hydroxyethyl)-3-methyl-4-aminoaniline sulfate salt
(6) 4-amino-3-methyl-N,N-diethylaniline
(7) 4-amino-N-(b-methoxyethyl)-N-ethyl-3-methylaniline.p-toluene sulfonate salt
(8) 4-amino-N-ethyl-N-(g-hydroxypropyl)-3-methylaniline.p-toluene sulfonate salt These color developing agents are used preferably at a concentration of 0.001 to 0.2 mol, more preferably 0.005 to 0.2 tool per liter of color developer.

In addition to the above color developing agents, known developer component compounds may be added to the color developer. It is a common practice to use a pH-buffering alkali agent, chloride ions, a developing inhibitor such as benzotriazole, a preservative, a chelating agent, or other additives.

The alkali agents used in the above color developing agent include potassium carbonate, potassium borate and trisodium phosphate. Other useful alkali agents include sodium hydroxide and potassium hydroxide used mainly to regulate pH levels. The pH of the color developer is usually in the range of 9 to 12, preferably in the range of 9.5 to 11.

While halide ions are frequently used for inhibiting development, for example, inhibiting development fog. Chloride ions from, for example, potassium chloride, sodium chloride, etc. are mainly used as the inhibitor because it inhibits the development fog without injuring to development speed. The chloride ion concentration is roughly not less than 3.0 $10^{-2}$ mol, preferably $4.0\times10^{-2}$ to $5.0\times10^{-1}$ mol per liter of color developer. The bromide ions, which are very effective in inhibiting development, are used roughly in an amount of not more than $1.0\times10^{-3}$, preferably not more than $5.0\times10^{-4}$ mol per liter of color developer.

Particularly effective organic preservatives include hydroxylamine derivatives (except hydroxylamine), hydroxamic acids, hydrazines, hydrazidoaminoketones, sugars, monoamines, cyamines, polyamines, quaternary ammonium salts, nitroxyl radicals, alcohols, oximes, diamide compounds, and condensed cyclic amines, with preference given to dialkyl-substituted hydroxlamines such as diethylhydroxylamine and alkanolamines such as triethanolamine.

Chelating agents used in the color developer of the invention include aminopolycarboxylic acid, aminopolyphosphonic acid, alkylphosphonic acid, and phosphonocarboxylic acid, with preference given to ethyleneaminetetraacetic acid, nitrilotriacetic acid, diethylenetriaminepentaacetic acid, and 1-hydroxyethylidene-1,1-diphosphonic acid.

Color developing temperature is usually not less than 15° C., usually in the range of 20° to 50° C. For rapid processing, it is preferably not less than 30° C.

Color developing time is generally 10 seconds to 4 minutes, but when rapid developing is desired, it is preferably 10 seconds to 1 minute, and 10 to 30 seconds when more rapid processing is desired.

In carrying out a running process while continuously replenishing the color developer, it is also preferable that the replenishing amount of the color developer is 20 to 60 ml per $m^2$ of light-sensitive material in order to eliminate overflowing liquid from the color developer bath so as to reduce pollution load caused by waste liquid.

The light-sensitive material of the invention is subjected to color developing, and then to bleaching and fixing. Bleaching may be carried out simultaneously with fixing. Fixing is normally followed by washing, which may be replaced with stabilizing.

The developing apparatus used for developing the light-sensitive material of the invention may be a roller transport type which transports the light-sensitive material by keeping the material nipped between rollers equipped in the processing tank, an endless belt type which transports the light-sensitive material by engaging the material with a belt, or, in particular, the light-sensitive material may be transported through slits in the processing tank while supplying a processing solution.

EXAMPLES

Examples of the invention are described below.

Example 1

Using a slide hopper, layers with the following compositions shown in Table 1 were formed by coating on a paper support having polyethylene lamination on one face and polyethylene lamination containing titanium oxide on the other face (emulsion layer side) to obtain a light-sensitive material. The coating solutions were prepared as follows.

Coating Solution for 1st Layer 26.7 g of a black coupler (shown in Table 1), 10.0 g of a dye image stabilizer (ST-1), 0.67 g of an antistain agent (HQ-1), and 6.67 g of a high boiling organic solvent (DNP) were dissolved in 60 ml of ethyl acetate. The resulting solution was emulsified and dispersed in 220 ml of a 10% aqueous gelatin solution containing 7 ml of a 20% surfactant (SU-1) using an ultrasonic homogenizer to obtain a black coupler dispersion. This dispersion was mixed with a blue-sensitive silver halide emulsion (containing 8.67 g of silver) prepared under the following conditions. As shown in Table 1, different amounts of gelatin were added so as to obtain light-sensitive materials of different gelatin coating weights, to which an anti-irradiation dye (AI-1) was added.

Coating Solution for 2nd Layer

A surfactant (SU-2) and a hardener (HH-1) were added to a 100 ml solution containing 2.0 g of gelatin to obtain a coating solution.

The following additives were used in each layer.

HH-1: 2,4-dichloro-6-hydroxy-S-triazine sodium
SU-1: Sodium tri-i-propylnaphthalene sulfonate
SU-2: Di(2-ethylhexyl) sulfosuccinate sodium
DNP: Dinonylphthalate
HQ-1: 2,5-di-t-octylhydroquinone

Preparation of Blue-sensitive Silver Halide Emulsion Em-B

To 1000 ml of a 2% aqueous solution of gelatin kept at 40° C., the following solutions A and B were added simultaneously in 30 minutes with the pAg regulated at 6.5 and the pH regulated at 3.0. Then, the following solutions C and D were simultaneously added in 180 minutes while maintaining the pAg at 7.3 and the pH at 5.5. The pAg was regulated according to the method disclosed in Japanese Patent O.P.I. Publication No. 45437/1984, and the pH was regulated using sulfuric acid or an aqueous solution of sodium hydroxide.

| | |
|---|---|
| Solution A | |
| Sodium chloride | 3.42 g |
| Potassium bromide | 0.03 g |
| Water was added to 200 ml. | |
| Solution B | |
| Silver nitrate | 10 g |
| Water was added to 200 ml. | |
| Solution C | |
| Sodium chloride | 102.7 g |
| Potassium bromide | 1.0 g |
| Water was added to 600 ml. | |
| Solution D | |
| Silver nitrate | 300 g |
| Water was added to 600 ml. | |

After adding the above solutions, the mixture was desalinized with a 5% aqueous solution of Demol N, a product of Kao Atlas, and a 20% aqueous solution of magnesium sulfate, and then mixed with an aqueous solution of gelatin to obtain a monodispersed emulsion EMP-1 comprising cubic grains having an average grain size of 0.85 μm, a coefficient of variation of 0.07 and a silver chloride content of 99.5 mol %.

The emulsion EMP-1 was chemically ripened using the following compounds at 50° C. for 90 minutes to obtain a blue-sensitive silver halide emulsion Em-B.

| | |
|---|---|
| Sodium thiosulfate | 0.8 mg/mol AgX |
| Chloroauric acid | 0.5 mg/mol AgX |
| Stabilizer (see Table 1) | $6 \times 10^{-4}$ mol/mol AgX |
| Sensitizing dye D-1 | $4 \times 10^{-4}$ mol/mol AgX |
| Sensitizing dye D-4 | $1 \times 10^{-4}$ mol/mol AgX |

STB-1

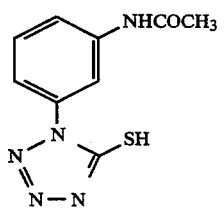

-continued
STB-2
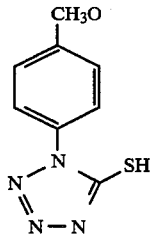
STB-3: 4-hydroxy-6-methyl-1,3,3a,7-tetrazaindene
D-1
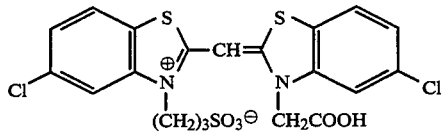
D-2
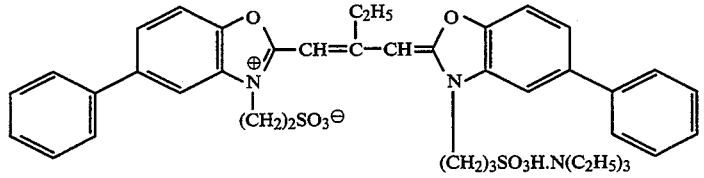
D-3
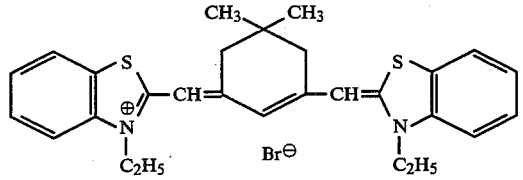
D-4
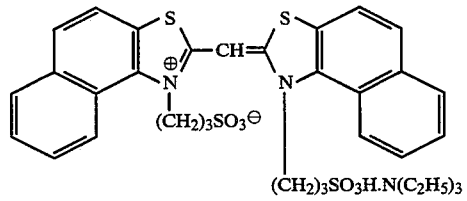
ST-1
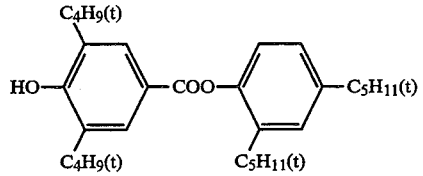
AI-1
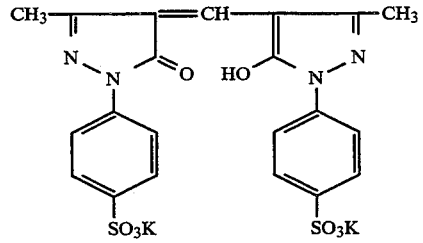
AI-2
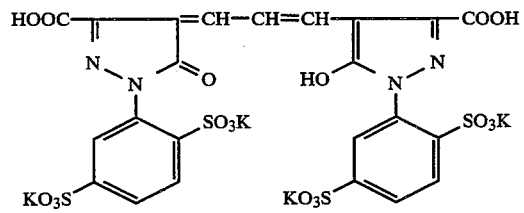

-continued

AI-3

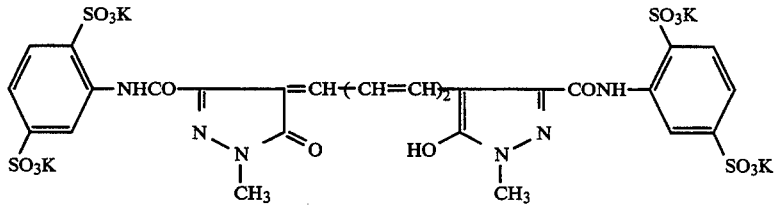

UV-1

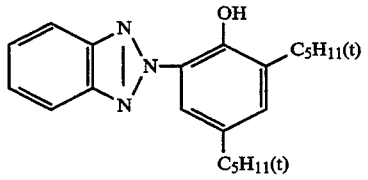

UV-2

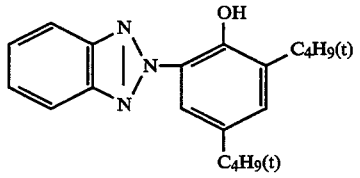

UV-3

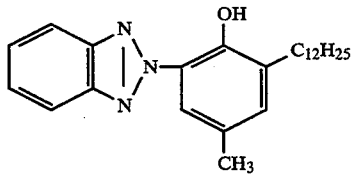

The samples undergone coating were evaluated as follows.

Evaluation of Tone

After exposed to blue light through an optical wedge according to a conventional method, each sample was subjected to the following processing steps and visually inspected for tone under a fluorescent lamp on the low density portion (density of not more than 0.3), medium density portion (density of 0.3 to 1.5), and high density portion (density of not less than 1.5).

| Processing steps | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30–34° C. | 90 sec. |
| Drying | 60–80° C. | 60 sec. |

The composition of each processing solution is described below.

| Color developer | Tank solution |
|---|---|
| Pure water | 800 ml |
| Triethanolamine | 10 g |
| N,N-diethylhydroxlamine | 5 g |
| Potassium chloride | 2.4 g |
| 1-hydroxyethylidene-1,1-diphosphonic acid | 1.0 g |
| Ethylenediaminetetraacetic acid | 1.0 g |
| N-ethyl-N-b-methanesulfonamidoethyl-3-methyl-4-aminoaniline sulfate | 5.4 g |
| Brightening agent (4,4'-diaminostylbenedisulfonic | 1.0 g |

-continued

| Color developer | Tank solution |
|---|---|
| acid derivative) | |
| Potassium carbonate | 27 g |

Water was added to 1 liter, and the pH was adjusted to 10.02.

| Bleach-fixer | |
|---|---|
| Ammonium ferric ethylenediaminetetraacetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |

Water was added to 1 liter, and the pH was adjusted to 5.7 using calcium carbonate or glacial acetic acid.

| Stabilizer | |
|---|---|
| F-1 | 1.0 g |
| Ethylene glycol | 1.0 g |
| 1-hyroxyethylidene-1,1-diphosphonic acid | 2.0 g |
| Ethylenediaminetetraacetic acid | 1.0 g |
| Ammonium hydroxide (20% aqueous solution) | 3.0 g |
| Brightening agent (4,4'-diaminostylbenedisulfonic acid derivative) | 1.5 g |

Water was added to 1 liter, and the pH was adjusted to 7.0 using sulfuric acid or potassium hydroxide.

The results are summarized in Table 1.

TABLE 1

| Sample No. | Black coupler type | Coating weight of gelatin (g/m$^2$) | Stabilizer type | Tone in low density portion | Tone in medium density portion | Tone in high density portion |
|---|---|---|---|---|---|---|
| 1 (comparative) | a-4 | 0.6 | STB-1 | Blue | Gray | Purple |
| 2 (comparative) | a-4 | 0.8 | STB-1 | Slightly bluish | Gray | Purple |
| 3 (inventive) | a-4 | 1.0 | STB-1 | Gray | Gray | Gray |
| 4 (inventive) | a-4 | 1.2 | STB-1 | Gray | Gray | Gray |
| 5 (inventive) | a-4 | 1.4 | STB-1 | Gray | Gray | Gray |
| 6 (comparative) | a-4 | 1.6 | STB-1 | Gray | Bluish gray | Strongly-bluish gray |
| 7 (comparative) | a-4 | 1.8 | STB-1 | Gray | Purplish gray | Purple |
| 8 (inventive) | a-4 | 1.0 | STB-2 | Gray | Gray | Gray |
| 9 (inventive) | a-4 | 1.2 | STB-2 | Gray | Gray | Gray |
| 10 (inventive) | a-4 | 1.4 | STB-2 | Gray | Gray | Gray |
| 11 (inventive) | a-4 | 1.0 | STB-3 | Bluish gray | Slightly-bluish gray | Gray |
| 12 (inventive) | a-4 | 1.2 | STB-3 | Slightly-bluish gray | Gray | Gray |
| 13 (inventive) | a-4 | 1.4 | STB-3 | Gray | Gray | Gray |
| 14 (comparative) | b-1 | 0.6 | STB-1 | Blue | Blue | Dark purple |
| 15 (comparative) | b-1 | 0.8 | STB-1 | Blue | Slightly-bluish gray | Dark purple |
| 16 (inventive) | b-1 | 1.0 | STB-1 | Slightly-bluish gray | Gray | Gray |
| 17 (inventive) | b-1 | 1.2 | STB-1 | Gray | Gray | Gray |
| 18 (inventive) | b-1 | 1.4 | STB-1 | Gray | Gray | Gray |
| 19 (comparative) | b-1 | 1.6 | STB-1 | Gray | Bluish gray | Purple |
| 20 (comparative) | b-1 | 1.8 | STB-1 | Gray | Blue | Dark purple |
| 21 (inventive) | b-1 | 1.4 | STB-2 | Gray | Gray | Gray |

As apparent from Table 1, when the coating weight of gelatin is within the range of the invention, a neutral gray image results across the low to the high density portions. When it is outside the range, dichroism or trichroism occurs, producing a image tone which can hardly be considered as black and white.

The stability of the neutral gray depends on the type of stabilizer. While STB-1 and STB-2 provide good stability, that provided by STB-3 is slightly poor.

Example 2

The following two types of emulsions were prepared in the same way as in Example 1.

Preparation of Green-sensitive Silver Halide Emulsion Em-G

A monodispersed emulsion EMP-2 containing cubic grains having an average grain size of 0.43 μm, a coefficient of variation of 0.08, and a silver chloride content of 99.5 mol % was prepared in the same way as EMP-1, except that the addition time of solutions A and B, and that of solutions C and D were changed.

EMP-2 was chemically ripened using the following compounds at 55° C. in 120 minutes to obtain a green-sensitive silver halide emulsion Em-G.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye D-2 | $4 \times 10^{-4}$ mol/mol AgX |

Preparation of Red-sensitive Silver Halide Emulsion Em-R

A monodispersed emulsion EMP-3 comprising cubic grains having an average grain size of 0.50 μm, a coefficient of variation of 0.08, and a silver chloride content of 99.5 mol % was obtained in the same way as EMP-1, except that the addition time of solutions A and B, and that of solutions C and D were changed.

EMP-3 was chemically ripened using the following compounds at 60° C. in 90 minutes to obtain a red-sensitive silver halide emulsion Em-R.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye D-3 | $1 \times 10^{-4}$ mol/mol AgX |

Using these emulsion types, multilayered light-sensitive material samples having the compositions shown in Tables 2 and 3 were prepared. The coupler types and addition amounts of gelatin are shown in Table 4.

TABLE 2

| Layer | Composition | Coating Weight (g/m$^2$) |
|---|---|---|
| 7th layer | Gelatin | 1.00 |
| 6th layer (UV absorbing layer) | Gelatin | 0.40 |
| | UV absorbent (UV-1) | 0.10 |
| | UV absorbent (UV-2) | 0.04 |
| | UV absorbent (UV-3) | 0.16 |
| | Antistain agent (HQ-1) | 0.01 |
| | DNP | 0.20 |
| | Anti-irradiation dye (AI-3) | 0.02 |
| 5th layer (red-sensitive layer) | Gelatin | See Table 4 |
| | Red-sensitive silver chlorobromide emulsion (Em-R) | 0.21 |
| | Black coupler (see Table 4) | 0.60 |
| | Dye-image stabilizer (ST-1) | 0.20 |
| | Antistain agent (HQ-1) | 0.01 |
| | DNP | 0.15 |
| 4th layer (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistain agent (HQ-1) | 0.03 |
| | DNP | 0.40 |

TABLE 3

| Layer | Composition | Coating Weight ($g/m^2$) |
|---|---|---|
| 3rd layer (green-sensitive layer) | Gelatin | See Table 4 |
| | Green-sensitive silver chlorobromide emulsion (Em-G) | 0.22 |
| | Black coupler (see Table 4) | 0.45 |
| | Dye-image stabilizer (ST-3) | 0.15 |
| | DNP | 0.10 |
| | Anti-irradiation dye (AI-2) | 0.01 |
| 2nd layer (intermediate layer) | Gelatin | 1.20 |
| | Antistain agent (HQ-1) | 0.10 |
| | DIDP | 0.06 |
| | Fungicide (F-1) | 0.002 |
| 1st layer (blue-sensitive layer) | Gelatin | See Table 4 |
| | Blue-sensitive silver chlorobromide emulsion (Em-B) | 0.26 |
| | Black coupler (see Table 4) | 0.80 |
| | Dye-image stabilizer (ST-1) | 0.30 |
| | Anti-stain agent (HQ-1) | 0.02 |
| | Anti-irradiation dye (AI-1) | 0.01 |
| | DNP | 0.20 |
| Support | Polyethylene laminated paper | |

The coating weight of silver halide emulsion is the amount converted to silver.
*Expressed as millimol/$m^2$.

F-1: 5-chloro-2-methylisothiazoline-3-one

The other compounds used were the same as those used for Example 1.

The so-obtained samples were exposed to white light through an optical wedge and then processed in the same way as Example 1.

The tone of each density portion was inspected. The results are shown in Table 4.

From Table 4, sample Nos. 24 to 26 containing gelatin within the range of the present invention have a stable neutral gray across the low density portion and the high density portion. In contrast, samples Nos. 22 and 23 containing gelatin less than that range exhibit a blue color, and sample No. 27 containing gelatin greater than that range exhibits a purple color, showing clearly that they cannot provide a stable gray tone. Though having multilayered constitution having emulsion layers of different spectral sensitivity as in the present example, samples (28 to 30) having a gelatin content outside the range of the invention even in one layer exhibit poor gray tone, so that they cannot produce a neutral gray tone across the whole density region.

Black couplers added to the three layers may be the same or different, wherein different combinations thereof may be arbitrarily used, as long as the gelatin content is within the range of the invention, as can be seen in samples 37 to 43 which reproduce a good gray tone.

TABLE 4

| | Blue-sensitive emulsion layer | | Green-sensitive emulsion layer | | Red-sensitive emulsion layer | | Tone in | Tone in | Tone in |
|---|---|---|---|---|---|---|---|---|---|
| Sample No. | Black coupler | Coating weight of gelatin ($g/m^2$) | Black coupler | Coating weight of gelatin ($g/m^2$) | Black coupler | Coating weight of gelatin ($g/m^2$) | low density portion tone | medium density portion tone | high density portion tone |
| 22 (comparative) | a-6 | 0.5 | a-6 | 0.5 | a-6 | 0.5 | Blue | Gray | Dark purple |
| 23 (comparative) | a-6 | 0.8 | a-6 | 0.8 | a-6 | 0.8 | Slightly bluish | Gray | Purple |
| 24 (inventive) | a-6 | 1.1 | a-6 | 1.1 | a-6 | 1.1 | Gray | Gray | Gray |
| 25 (inventive) | a-6 | 1.3 | a-6 | 1.3 | a-6 | 1.3 | Gray | Gray | Gray |
| 26 (inventive) | a-6 | 1.5 | a-6 | 1.5 | a-6 | 1.5 | Gray | Gray | Gray |
| 27 (comparative) | a-6 | 1.8 | a-6 | 1.8 | a-6 | 1.8 | Gray | Bluish gray | Blue |
| 28 (comparative) | a-6 | 1.1 | a-6 | 0.8 | a-6 | 1.1 | Gray | Slightly bluish | Slightly purple |
| 29 (comparative) | a-6 | 1.1 | a-6 | 1.1 | a-6 | 0.8 | Slightly bluish | Slightly bluish | Dark blue |
| 30 (comparative) | a-6 | 1.1 | a-6 | 1.1 | a-6 | 1.8 | Slightly blue | Gray | Dark blue |
| 31 (comparative) | b-5 | 0.5 | b-5 | 0.5 | b-5 | 0.5 | Blue | Gray | Purple |
| 32 (comparative) | b-5 | 0.8 | b-5 | 0.8 | b-5 | 0.8 | Slightly bluish | Gray | Purple |
| 33 (inventive) | b-5 | 1.1 | b-5 | 1.1 | b-5 | 1.1 | Gray | Gray | Gray |
| 34 (inventive) | b-5 | 1.3 | b-5 | 1.3 | b-5 | 1.3 | Gray | Gray | Gray |
| 35 (inventive) | b-5 | 1.5 | b-5 | 1.5 | b-5 | 1.5 | Gray | Gray | Gray |
| 36 (comparative) | b-5 | 1.8 | b-5 | 1.8 | b-5 | 1.8 | Slightly bluish | Purple | Dark blue |
| 37 (inventive) | a-3 | 1.3 | a-3 | 1.1 | b-2 | 1.0 | Gray | Gray | Gray |
| 38 (inventive) | a-3 | 1.5 | a-3 | 1.1 | b-2 | 1.3 | Gray | Gray | Gray |
| 39 (inventive) | a-3 | 1.3 | a-6 | 1.1 | b-1 | 1.0 | Gray | Gray | Gray |
| 40 (inventive) | a-3 | 1.3 | a-6 | 1.1 | b-3 | 1.0 | Gray | Gray | Gray |
| 41 (inventive) | a-3 | 1.3 | a-2 | 1.1 | b-1 | 1.0 | Gray | Gray | Gray |
| 42 (inventive) | a-3 | 1.3 | a-2 | 1.1 | b-3 | 1.0 | Gray | Gray | Gray |

Example 3

Sample Nos. 9 and 17 of the invention prepared in Example 1, and Sample Nos. 25 and 41 of the invention prepared in Example 2 were used to print and enlarge the image on the color negative film subjected to usual photographying. The image quality on each sample was then evaluated.

The results showed that although all of the samples gave a black and white print with a uniform neutral gray tone throughout all density portions, Sample Nos. 9 and 17 were inferior to Sample Nos. 25 and 41 in gradation reproducibility of the subject color and graininess. To sum up, for printing using a color negative, it was found preferable to use a light-sensitive print material designed to be sensitive to three colors, i.e., the blue, green, and red colors as in the case of color papers.

We claim:

1. A silver halide photographic light-sensitive material having a silver halide emulsion layer on a support, wherein the silver halide in the silver halide emulsion layer is silver bromochloride having a silver bromide content of 0.1 to 2.0 mol % and containing substantially no silver iodide; the silver halide emulsion layer containing a coupler selected from a resorcinol-based dye-forming coupler and a meta-aminophenol-based coupler, and gelatin in a coating weight of 1.0 to 1.5 g/m$^2$.

2. A silver halide photographic light-sensitive material of claim 1, wherein the coupler is

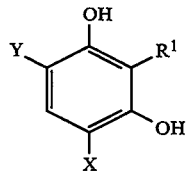

wherein $R^1$ represents a hydrogen atom, a substituted or unsubstituted alkyl group, a —$COR^2$ group, an —$NHCOR^2$ group, a —$CONHR^2$ group,

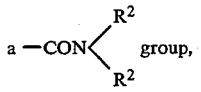

an —$SO_2NHR^2$ group

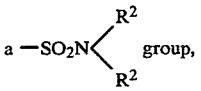

or an —$SO_2R^2$ group; $R^2$ represents a substituted or unsubstituted alkyl group having 1 to 20 carbon atoms, or a substituted or unsubstituted aryl group having 1 to 20 carbon atoms;

X and Y independently represent a hydrogen atom, a substituted or unsubstituted alkyl group, or a halogen atom; or

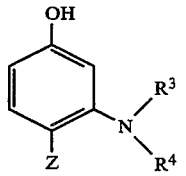

wherein $R^3$ and $R^4$ independently represent a hydrogen atom, a substituted or unsubstituted alkyl group having 4 to 20 carbon atoms, a substituted or unsubstituted aryl group having 4 to 20 carbon atoms, or a substituted or unsubstituted alkenyl group having 4 to 20 carbon atoms; Z represents a hydrogen atom, a sulfone group, or a halogen atom.

3. A silver halide photographic light-sensitive material of claim 2, wherein $R^1$ is a substituted or unsubstituted alkyl group having 1 to 20 carbon atoms.

4. A silver halide photographic light-sensitive material of claim 2, wherein X is a substituted or unsubstituted alkyl group having 1 to 20 carbon atoms.

5. A silver halide photographic light-sensitive material of claim 2, wherein Y is a substituted or unsubstituted alkyl group having 1 to 20 carbon atoms.

6. A silver halide photographic light-sensitive material of claim 1, wherein an amount of the coupler is 3 to 15 mol % per mol of silver halide.

7. A silver halide photographic light-sensitive material of claim 6, wherein an amount of the coupler is 5 to 10 mol % per mol of silver halide.

8. A silver halide photographic light-sensitive material having a silver halide emulsion layer on a support, wherein silver halide in the silver halide emulsion layer is silver chlorobromide having a silver bromide content of 0.1 to 2 mol %; the silver halide emulsion layer contains a meta-aminophenol-based coupler, and gelatin in a coating weight of 1.0 to 1.5 g/m$^2$.

9. An image forming method comprising development of an imagewise exposed silver halide photographic light-sensitive material with a color developer containing a color developing agent, the silver halide photographic light-sensitive material having a silver halide emulsion layer on a support; wherein silver halide in said silver halide emulsion layer is silver bromochloride having a silver bromide content of 0.1 to 2.0 mol % and containing substantially no silver iodide; said emulsion layer contains a coupler selected from a resorcinol-based dye-forming coupler and a meta-aminophenol-based coupler, and gelatin in a coating weight of 1.0 to 1.5 g/m$^2$.

10. An image forming method of claim 9 wherein the color developing agent is an aminophenol developing agent or p-phenylenediamine developing agent.

11. An image forming method of claim 10 wherein the color developing agent is (1) N,N-dimethyl-p-phenylenediamine hydrochloride,
(2) N-methyl-p-phenylenediamine hydrochloride,
(3) 2-amino-5-(N-ethyl-N-dodecylamino)toluene,
(4) N-ethyl-N-(b-methanesulfonamidoethyl)-3-methyl-4-aminoaniline sulfate salt,
(5) N-ethyl-N-(b-hydroxyethyl)-3-methyl-4-aminoaniline sulfate salt,
(6) 4-amino-3-methyl-N, N-diethylaniline,
(7) 4-amino-N-(b-methoxyethyl)-N-ethyl-3-methylaniline.p-toluene sulfonate salt, or
(8) 4-amino-N-ethyl-N-(g-hydroxypropyl)-3-methylaniline.p-toluene sulfonate salt.

* * * * *